US008349148B2

(12) United States Patent
Tarrant et al.

(10) Patent No.: US 8,349,148 B2
(45) Date of Patent: Jan. 8, 2013

(54) SPRAY FORMED GALVANIC ANODE PANEL

(75) Inventors: Derek Tarrant, Weaverville, NC (US); Michael T. Mather, Greeneville, TN (US)

(73) Assignee: Jarden Zinc Products, LLC, Greeneville, TN (US)

( * ) Notice: Subject to any disclaimer, the term of this patent is extended or adjusted under 35 U.S.C. 154(b) by 97 days.

(21) Appl. No.: 13/003,588

(22) PCT Filed: Jul. 13, 2009

(86) PCT No.: PCT/US2009/050416

§ 371 (c)(1), (2), (4) Date: Jan. 11, 2011

(87) PCT Pub. No.: WO2010/006336

PCT Pub. Date: Jan. 14, 2010

(65) Prior Publication Data

US 2011/0108413 A1 May 12, 2011

Related U.S. Application Data

(60) Provisional application No. 61/079,974, filed on Jul. 11, 2008.

(51) Int. Cl.
*C23F 13/08* (2006.01)

(52) U.S. Cl. ..... 204/196.36; 204/196.18; 204/196.25; 204/196.3; 204/196.17; 204/280; 205/734

(58) Field of Classification Search ..... 204/196.17, 204/196.18, 196.19, 196.25, 196.3, 280, 204/284, 196.36; 205/734
See application file for complete search history.

(56) References Cited

U.S. PATENT DOCUMENTS

| | | | |
|---|---|---|---|
| 4,109,648 | A | 8/1978 | Larke |
| 5,292,411 | A | 3/1994 | Bartholomew |
| 5,714,045 | A | 2/1998 | Lasa |
| 6,193,857 | B1 | 2/2001 | Davison et al. |
| 6,958,116 | B1 | 10/2005 | Bennett |
| 7,160,433 | B2 | 1/2007 | Bennett |
| 7,183,230 | B2 | 2/2007 | Elkouh |
| 7,226,532 | B2 | 6/2007 | Whitmore |

FOREIGN PATENT DOCUMENTS

| | | | |
|---|---|---|---|
| JP | 5-97499 | | 4/1993 |
| JP | 05-097499 | * | 4/1993 |
| JP | 10-2003-00888807 | | 4/1993 |
| JP | 59-173428 | | 1/2007 |
| JP | 2008-57016 | | 3/2008 |

* cited by examiner

*Primary Examiner* — Bruce Bell
(74) *Attorney, Agent, or Firm* — Lawrence J. Shurupoff

(57) ABSTRACT

An electrolytic mortar for fabricating galvanic anode panels is strengthened with fibers to improve green strength and resistance to cracking. Elongated reinforcing fibers are introduced into a flowing stream of mortar and deposited in multiple layers upon a platen or mold. A sacrificial zinc anode of open construction is embedded between the multiple layers to allow for electrolytic conduction between the layers and over all surfaces of the zinc anode.

14 Claims, 6 Drawing Sheets

FIG 9A
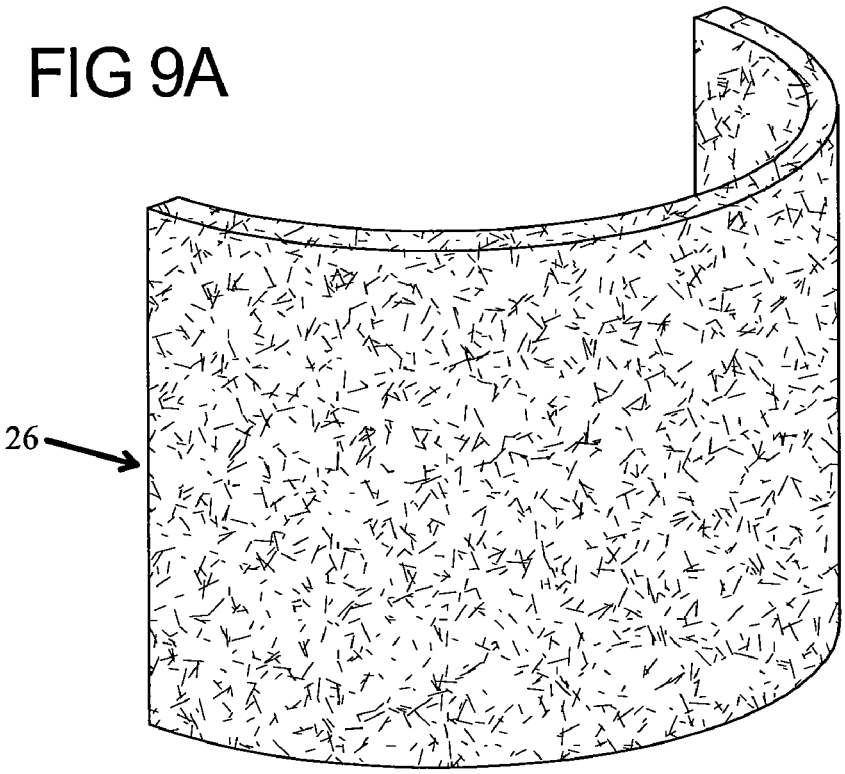
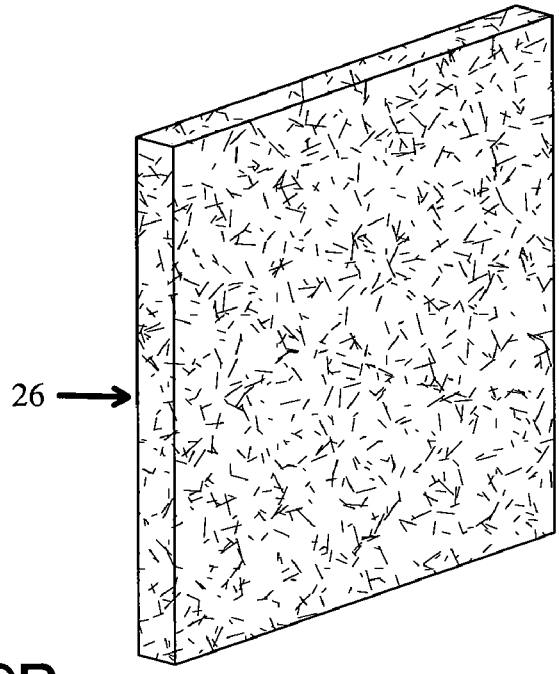
FIG 9B

SPRAY FORMED GALVANIC ANODE PANEL

This application is a 371 of PCT/US09/050416 filed on Jul. 13, 2009, which claims priority of provisional application 61/079,974 filed Jul. 11, 2008.

BACKGROUND AND SUMMARY

Steel reinforcing rods embedded in concrete structures corrode in reaction with chlorides present in concrete. Electrically connecting a zinc anode to the reinforcing steel and placing the zinc anode in a position where the flow of ions is permitted through the surrounding concrete structure serves as an effective means of preventing such corrosion.

When concrete deteriorates and/or becomes spalled, shuttering and forms are used to contain wet cement used to repair the concrete. These forms are temporary and have no anodic function. A jacketing system as described in U.S. Pat. No. 5,714,045 has been used which is permanent, has an anode and works in wet zone areas. The jacketing system, however, may not perform optimally in dry zone areas or those that might become dry at some time.

This disclosure describes a method of making a dry prefabricated panel containing a zinc anode plus a solid electrolyte which works in wet and dry zone areas, a method of attaching such a prefabricated composite panel to concrete structures, a method to use the panel as a shuttering or form for molding and forming concrete or mortar used to fill and repair spalled areas and panel constructions formed by such methods.

In one embodiment, solid electrolytic mortar or cement, which is preformed by a liquid spraying method, produces a laminated or layered panel for use as a sacrificial galvanic anode. A zinc anode plus one more electrically conductive anode connecting wires are embedded, sandwiched or laminated within the solid electrolyte. The panel maintains galvanic activity under low humidity conditions and quickly and easily reactivates from a dry state when re-hydrated.

Panels according to this disclosure can be made by spraying a liquid mixture of ingredients which later set to form a solid electrolyte mixture serving as a galvanic cement. The solid electrolyte mixture is uniquely different from conventional cements in that when set, the pH of the mixture is between 10.5 and 11.0. This relatively low pH facilitates the use of conventional glass fiber reinforcement without degradation of the glass fibers.

Conventional glass fibers cannot be used in conventional Portland cement mixes, as these mixes have a pH of about 12.5. This relatively high alkaline pH corrodes the surface of the glass fibers and leads to weakening of the cement composite. Special high alkaline resistant glass fibers can be used but these are much more expensive than conventional glass fibers. Moreover, conventional glass fibers cannot be used in any conductive galvanic cements which have a pH of 12.5 or higher without risk of fiber degradation and weakening of the composite. Again, special high alkaline resistance glass fibers can be used, but these are much more expensive.

In another embodiment, a glass fiber reinforcing technique produces a finished product in the form of a panel which is strong enough to serve as a functional structural member which can retain, shape and form wet cement during the repair of concrete structures.

A multi-component solid electrolyte panel system developed for use in dry zone cathodic protection of reinforced concrete structures includes a zinc anode, such as in the form of a wire mesh, expanded metal, a knitted or woven grid, a perforated sheet or any other suitable form preferably an open form. Openings or gaps in the zinc anode material allow for physical reinforcement of the panel throughout its entire thickness as the mortar flows through the spaces or openings in the zinc anode material. Large flat galvanic panels mounted onto planar reinforced concrete surfaces suffer from a degree of shielding of the anode surface facing away from the structure. Openings in the anode therefore also facilitate electrical galvanic activity on the side of the anode facing away from the reinforced concrete structure and improve the overall galvanic performance of the anode. The panel can be further strengthened by the addition of staple glass fibers to the panel mortar or cement in a manner similar to glass reinforced plastic materials. Quartz sand can also be used as an optional void filler and reinforcing filler.

In another embodiment, the solid electrolyte mortar which forms the panel matrix is made by mixing two liquid mortar components to which fillers are then separately added. This mixture reacts and hardens over a 24 hour period. To fabricate a panel according to this disclosure, the liquid mortar components of the solid electrolyte system are premixed and adjusted with an addition of water to provide a viscosity suitable for pumping or spray application. This mixture is pumped or sprayed to form a stream into which can be entrained any combination of or all of the following components: sand or similar particulate mineral filler; a lenticular reinforcing mineral filler such as Wollastonite; natural mineral fibers similar to Asbestos; synthetic organic fibers such as polyester; and synthetic inorganic fibers such a glass staple fibers. The fillers can be introduced directly into the flowing mortar stream or introduced into a separate stream which is combined with the mortar stream.

The two separate streams of wet mortar and dry filler components combine into a composite mixture and the combined streams form a spray which is sprayed and deposited onto a carrier panel or mold selected from a material which will release the composite when it has dried. A steel or aluminum platen can be used for this purpose, as can a plastic or wood platen. The platen can be coated with a conventional lubricant or release agent prior to application of the stream of wet composite material. The platens can be oversized to allow for the production of oversized anode panels, which when dried and solidified, can be cut or trimmed to a final desired shape and size.

Once a suitable initial thickness of composite mortar material has been sprayed or otherwise deposited onto a carrier panel or shaped mold, the wet composite mixture can be consolidated by the use of a multiple disc roller to compress the composite mortar material and remove trapped air pockets. When the wet composite mortar material is free of air, a zinc anode is positioned in place on top of the wet composite mortar material deposited on the platen. Further spraying of the liquid and filler components resumes to embed the zinc anode within the wet composite mortar material and build the final thickness of the panel.

The thickness of the sprayed electrolyte/particulate filler/fiber mortar mixture applied before and after placing and/or laminating the zinc anode on a platen can be varied so as to place the anode centrally or biased towards either finished panel surface. The relative proportions of electrolyte, particulate filler and fiber reinforcement can also be varied to modify the physical properties of the finished product. The panel is finished by connecting a wire to the zinc anode which can be formed as a mesh, grid or perforated metal anode.

The finished panel has the potential to be used in the repair of planar and three dimensional concrete structures. Significant advantages of the panel include the prefabrication of electrolytic anode materials which reduces expensive "on the job" work. The panel is strong enough to act as a "leave in place" shuttering, mold, or formwork for concrete repair. The unique construction technique allows for the prefabrication of simple or intricate two and three dimensional forms, such as forms to fit the external surface of cylindrical concrete columns, pilings or the complex junctions of two or more support piles, for example. Moreover, there is sufficient compliance in the finished anode panel to bend to accommodate surface irregularities or "out of round" piles.

A particular advantage of preforming a glass fiber reinforced anode panel prior to application in the field is the ability to use a thinner layer of concrete or mortar than that used in applications where the anode panel is applied in the field with liquid concrete. When applied in the field, liquid concrete requires significant time to set and solidify. In the case of the subject preformed fiber-reinforced anode panel, a mold can be formed in the shape of the component or object or application to which the anode is to be applied such that a glass fiber reinforced anode is preformed on a platen or mold, taken in solid form to the field, and applied directly in the field without the requirement of concrete pouring and setting. This is an advantage over prior techniques that had to be assembled in the field where forming proper concrete joints was quite difficult and often required expensive rework where the poured concrete did not form a proper seal or joint around the object to which the anode was applied.

It can be appreciated that field labor and construction costs are significantly reduced and significant time savings are achieved with the subject glass fiber reinforced anode. In addition, greater quality control in the fabrication of the subject glass fiber reinforced anode can be achieved in the factory than in the field.

In the case of flat surfaces to which the glass fiber anode panel is applied, preformed sheets of flat panel may be fabricated, taken to the field, and simply cut to shape in those cases where planar surfaces are to be protected by application of a glass fiber reinforced anode panel. Large cylindrical concrete piles can be covered with two or more arcuate panels formed on arcuate molds. These panels, which can be formed as segments of a cylinder, can be applied in the field as sections to form a sleeve around a concrete piling or other cylindrical support. Flat panels can be easily applied to flat concrete surfaces in the field.

It should be noted that glass fibers prevent the breaking of the solid mortar electrolyte and allow the electrolyte to be formed without adhesives. In this manner, instead of the electrolyte mortar forming an adhesive bond with the underlining substrate to which the anode is applied, the glass fiber reinforced anode panel can be applied in the field with a separate adhesive. While microcracks may occur in the solid electrolyte panel, the glass fibers prevent any one crack from propagating to the point where the panel actually breaks.

Fibrous reinforcing materials, such as the glass fibers noted above, can be used alone or with particulate filler materials added to the fiber spray stream. The filler material can be of conventional particle shape (roughly irregular spheres), platelet shaped. The reinforcing material can also be chosen with advantage from synthetic or natural fillers which have lenticular or needle-like configurations—such as natural Wollastonite, which is a calcium silicate. These elongated pigment particles have an aspect ratio (ratio of length to width/thickness). Particles having a higher aspect ratio have a noticeable effect in increasing the strength of the final solidified form of the galvanic cement used as a matrix for the panel.

The filler material added to the electrolytic mortar can be a natural expanded material like vermiculite or pearlite or a synthetic product such as polystyrene or various forms of ground plastic foam. In use, the zinc anode corrodes within the panel. This corrosion creates oxides and other corrosion products that occupy more space that the initial volume of the zinc metal which created them. The use of expanded or spongy materials as fillers allows for these fillers to be crushed within the panel to yield extra space for the oxidation products of the Zinc anode which would otherwise exert disruptive and destructive stress on the anode panel itself or create stress within the galvanic cement that holds the panel onto a substrate. The use of ground plastic foam or other void formers creates air pockets which satisfy the expansion needs of the zinc corrosion products. The filler material can also include short staple fibers like glass.

As noted above, a spray-formed galvanic anode panel is produced by spraying a mixture of liquid stage conductive cement (hereafter referred to as "liquid"), glass fibers and optional filler material around a zinc anode. The liquid can be sprayed from a conventional pneumatic spray gun, a high-volume low-pressure spray gun, an airless pressure spray gun or combinations of these spray guns. The sprayed liquid is directed towards a collector mold or pattern.

The glass fibers are introduced into an air stream and conveyed towards a collector mold. The sprayed liquid stream and the air stream containing entrained glass fibers meet at the surface of the collector mold or ideally mix in a combined airstream before meeting the collector mold. A deposit of liquid coated glass fibers is collected on the surface of a mold which can be planar or three dimensional in form.

At some stage after a certain thickness of liquid coated fibers has built up on the collector mold, a zinc anode is laid onto the wet mortar and composite deposited on the collector mold surface. The zinc anode is ideally in an expanded, perforated, mesh or other open form and is formed to fit and conform to the surface of the liquid-coated fibers on the surface of the collector mold. Once the zinc anode is in place, the deposition of liquid coated fibers continues and adds a further coating of liquid coated fibers onto the exposed surface of the zinc anode. This additional application of mortar and glass fibers (liquid) serves to incorporate and laminate or embed the zinc anode within the mass of liquid coated fibers.

The deposit of liquid coated fibers and integral zinc anode on the collector mold is preferably consolidated before the liquid hardens. Adjustments of the amount of liquid coated fibers before and after adding the zinc anode to the panel assembly allows for any thickness of reinforced anode panel on either side of the zinc anode. Thus, an asymmetric placement of the zinc anode within the final cured panel can be achieved, with the ability to present the anode closer to the surface of the reinforced concrete which contains the reinforcing steel or rebar which need to be protected. This allows for a shorter galvanic path, less impeded by the glass (or other) fiber panel reinforcements or fillers.

It is also possible by modifying the ratio of liquid to fiber sprayed at various stages of the production of a panel to achieve a panel surface rich with a greater concentration of the galvanically active conductive electrolyte mortar material on the side of the panel presented to the concrete surface than on its other (exterior) side. This reduces any interference to the flow of protective ionic current that may be presented by the fiber reinforcement on the side of the panel presented to the concrete surface containing the steel to be protected. The thinner internal (concrete side) section will have lower strength as will an inner section made with a liquid rich construction. The overall strength of the panel can be restored by a thicker external panel section which is thicker and/or contains a higher percentage of reinforcing glass fibers. These two processes can be arranged to be seamless so no distinct layers are produced.

Formed anode panels of any construction described herein can be fixed to a reinforced concrete surface to be galvanically protected by cementing a galvanic anode panel to the concrete with fresh conductive electrolyte adhesive, or cementing the panel to the concrete with cement adhesive material, or using either of these two methods augmented by optional concrete screws or other types of mechanical anchors which can be left in place after the cement or mortar has set or removed. These mechanical anchors attach the panels to uncompromised areas of the underlying concrete.

Attaching the galvanic panels to damaged reinforced concrete can be arranged such that the prefabricated galvanic anode panels cover spalled and damaged areas of the concrete. Such covered areas can then be filled with conventional liquid concrete or galvanic adhesive with the galvanic panels acting as "leave in place" shuttering. The concrete or galvanic adhesive filling can be achieved for example by drilling a series of holes in the galvanic panel and injecting concrete or galvanic adhesive mix though these holes. These holes can be plugged after injection.

Formed galvanic anode panels can be fixed to a concrete surface to be protected "dry"—that is without any conventional or galvanic adhesive. These panels can be fixed by conventional concrete anchors and may be arranged such that a cavity exists behind the entire panel. These panels can be arranged such that they butt together and seal over the surface of the concrete to be protected. Alternatively, these panels can be fitted with a perimeter seal which defines a cavity behind the panel. Seals can be in the form of a blade or flexible barrier seal or a compressible seal, or formed by a liquid adhesive, for example a construction adhesive, which sets and seals the edges of the panels prior to cavity filling.

Once sealed, the cavities behind the galvanic panels are filled by injection with conductive galvanic adhesive or a cement mix which sets and provides a galvanic path for the protective galvanic current as well as adding additional anchoring for the galvanic panel. Freshly applied concrete within the cavity behind the galvanic anode panel can have a low ionic conductivity when fresh, which can impede substantial immediate galvanic protection of the reinforcing steel. This changes with time as chlorides from the existing concrete permeate through the fresh concrete and regular galvanic protection is established. To prevent or offset this impediment to initial galvanic protection, the cavity defined by the panel can be filled with an adhesive which can be adjusted to provide enhanced immediate and long term galvanic protection of the underlying steel reinforcement. The cavity can also be filled with a conventional concrete dosed with electrolytes to provide enhanced ionic conduction for immediate galvanic protection of the underlying steel.

Finished panels can include external coatings applied before or after the panels are affixed to a concrete structure. These coatings can be cementitious or polymeric, impervious or permeable. Such exterior coatings can be tailored to control the conditions within the reinforced concrete structure which is being protected and can be arranged to improve the abrasion or external damage resistance of the panel.

Examples of successfully applied organic polymeric coatings are Epoxy and polyurea. Examples of cementitious coatings are Portland cement based mixtures with fine mineral fillers. These cementitious coatings can be dosed with organic emulsion polymers to control ultimate permeability of the final coating.

BRIEF DESCRIPTION OF THE DRAWINGS

In the drawings:

FIGS. 9A and 9B are views in perspective showing several prefabricated composite anode panels cut to a desired size from a panel as shown in FIGS. 4 and 8, and showing an arcuate panel formed from an arcuate platen or mold in FIG. 9A and a flat panel formed from a flat platen or mold in FIG. 9B;

In the various views of the drawings, like reference numerals designate like or similar components.

DESCRIPTION OF REPRESENTATIVE EMBODIMENTS

Figure 1:
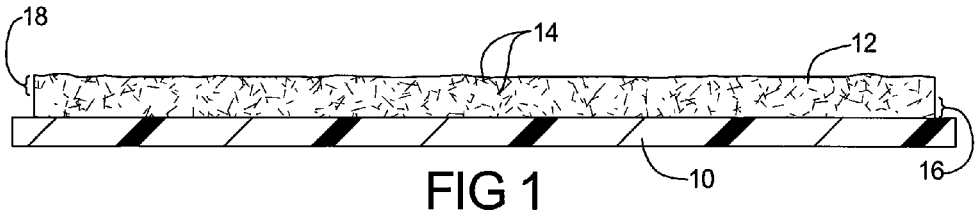
FIGS. 1-4 are cross sectional views of the sequential steps of manufacture of a composite anode panel fabricated in accordance with one embodiment of the disclosure.

A first example of a new process for manufacturing an improved glass fiber reinforced composite galvanic anode panel uses an electrolytically conductive concrete or mortar matrix component which need only be approximately a quarter of an inch thick. This thin section can be compared to anodes which are applied in the field with one or more layers of liquid concrete which are typically several inches thick, or more. This reduction in thickness in the subject anode panels is due to the ability of the electrolytic mortar in the panels to more effectively react chemically to promote the electrolytic process and deal with the waste oxidation products. This is achieved by sequestrating these oxidation products by a complexing process which chemically combines the oxidation products into a portion of mortar. This complexing process is able to lock away large quantities of oxidation products without the need for large pore volumes. Concrete, by contrast functions only by having some vacant void volume in which to store the oxidation products. This only works as long as these oxidation products can migrate to fill these voids and then only while the system stays wet.

The solid electrolyte mortar used to construct anode panels can be based on a modification of a commercially available product called TAS-EZA, produced by Composite Anode Systems GmBH in Wein, Germany. This electrolyte mortar normally comes in three packages:

TAS-EZA

Component A—viscous liquid—approx 40% by weight

Component B—water thin liquid—approx 20% by weight

Component C—silica sand filler—approx 40% by weight

The manufacturer's procedure instructs one to mix components A+B with a high speed stirrer (this mixture thickens somewhat during stirring) then mix in component C. In order to produce a glass reinforced anode according to this embodiment, the 40% silica sand filler is replaced in whole or in part with glass fibers. In one example, all of component C is replaced with about 28% by weight of glass fibers of about 1 to 2 inches in length and mixed with about 48% by weight of component A and about 24% by weight of component B so that component A and component B are raised in weight ratio to a total of about 72%. While mixtures of glass fibers and component C (sand) can be added to components A and B, the structural integrity of the final solid electrolyte begins to decline when greater than about 28% by weight of glass fibers is used. The spray procedure mixes components A+B, adjusts the viscosity slightly with a small quantity of water if needed, then uses a pressure pump sprayer gun to create a wide fan spray pattern. A glass fiber chopping unit atop the wide fan spray gun air conveys chopped glass fibers into the wide fan spray where the fibers mix with droplets of liquid A+B. The entire sprayed mixture is directed onto a mold surface. The spray arrives at the mold surface appearing like wet shredded wheat. Once a sufficient spray thickness has been deposited, a textured roller (textured to discourage the wet mix sticking to the roller) is used to manually consolidate the glass and electrolyte mix and remove entrained air.

This process can be repeated to lay down a second layer of sprayed mortar and glass fibers, then adding a zinc mesh anode at an appropriate point during the process, until a sufficient overall thickness is achieved and the zinc anode is encapsulated in the center or interior of the composite.

Another example of a process for manufacturing a glass reinforced galvanic anode panel is represented in FIGS. 1-4 wherein a panel is produced on an oversized platen or mold 10. The electrolytically conductive mortar 12 includes tecto-alumino silicate and a setting agent including an alkali and potassium silicate. Glass fibers 14 are mixed with the mortar 12 as described above.

A first portion or base layer 16 of mortar-soaked glass fibers is sprayed onto the mold 10, as described above. A conventional mold release agent can be applied to mold 10 prior to spraying. This first layer 16 is then rolled and consolidated to remove air pockets. A second portion or intermediate layer 18 of mortar-soaked glass fibers is then sprayed over the first layer of consolidated wet mortar and glass fibers.

Figure 2:
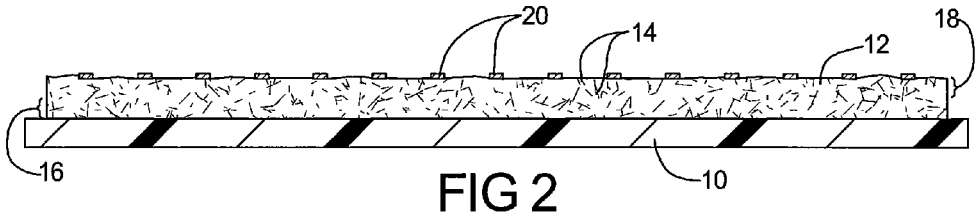

A sacrificial anode such as in the form of a zinc mesh material having zinc strands 20 arranged in a criss-cross gird is positioned, aligned and laid on top of the second layer 18 of unconsolidated mortar soaked glass fibers as shown in FIG. 2. Then, as seen in FIG. 3, additional wetted mortar soaked glass fibers are sprayed over the zinc strands 18 and on top of the second layer 18 to form a third or top layer 22 of mortar soaked glass fibers.

Figure 3:
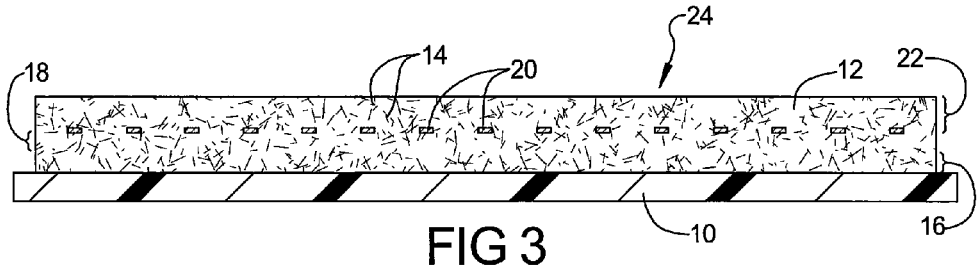

The entire multi-layered composite of FIG. 3 is then consolidated by rolling and compression to form a wet panel 24. Wet panel 24 is left to dry for about 24 hours then removed from the mold 10 and trimmed along its edges to produce the finished panel 26 shown in FIG. 4. All layers 16, 18 and 22 are in electrolytically conductive contact or communication as the mortar 20 passes through holes or perforations in the anode material 20.

The anode material 20 is advantageously formed from a continuous piece of sacrificial material which can be solid or perforated or expanded to provide extra surface area and facilitate the passage of galvanic current from all parts and surfaces of the anode; however, the anode material could be formed from a conglomerate or mass of electrically conductive sacrificial anode material particles or pieces at least partially in contact with itself throughout the panel. This arrangement defines interconnected voids between the electrically conductive material with the ionically conductive cement/mortar material in the voids so as to define the at least one ionically conductive path.

Another example of producing a fiber-reinforced galvanic anode panel is shown in FIGS. 5-8. In this embodiment, the fibers 14 can be staple glass fibers of varying lengths from a fraction of an inch up to several inches, or other types of fibers such as natural fibers like cotton, hemp, paper, mineral fibers similar to asbestos, and synthetic fibers.

In addition to the mortar reinforcing fibers 14, any one or more additives may be added downstream of the mortar sprayer.

That is ideally only mortar should be sprayed from the gun without any glass fibers as these can result in a high viscosity mortar which cannot be properly sprayed by conventional spraying equipment. Depending on the filler material a small percentage of filler can be added to the mortar prior to spraying although larger amounts make the mortar more difficult to spray properly.

However, additional particles can be added to the airborne mortar stream downstream from the mortar's exit from a spray gun. In particular, filler material can be added as an air conveyed mix and blended midair into the mortar stream or into the combined mortar and fiber stream noted previously.

Figure 5:
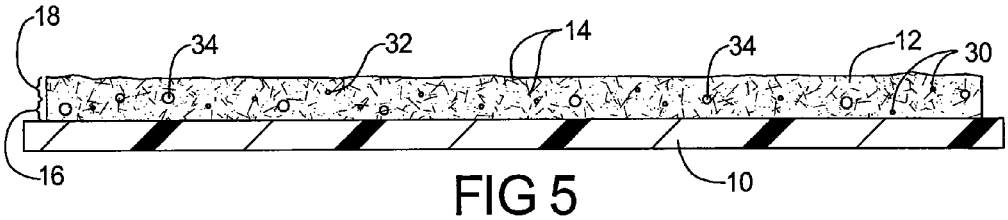
FIGS. 5-8 are cross sectional views of the sequential steps of manufacture of a composite anode panel fabricated in accordance with a second embodiment of the disclosure.

In one example as represented in FIG. 5, a medium to large particle marble sand filler 30 can be provided to the mortar 12 and fibers 14. Instead of a sand filler, needle-shaped particles 32 of calcium silicate called Wollastonite can be added to the mortar 12 and fibers 14. These three components (electrolytic mortar, glass fibers and Wollastonite) have shown, when used without additional fibers, an improved green or wet strength and a higher strength when dry than when sand is used as a filler.

Figure 6:
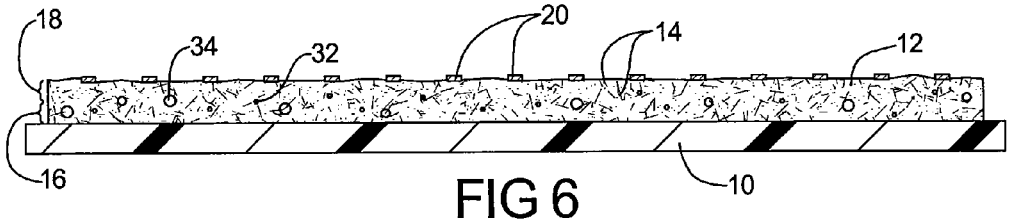
Figure 7:
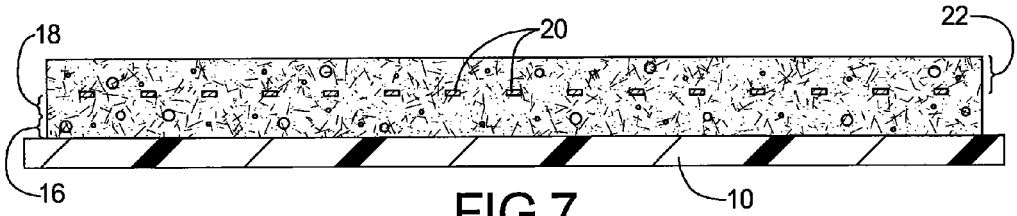
Figure 8:
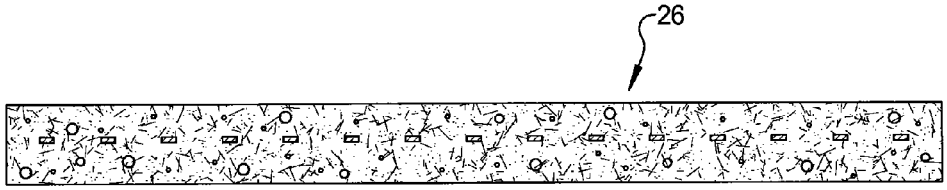

Additional additives 34 like pearlite and vermiculite can be added to the composite in a separate airstream to allow for expansion caused by the formation of zinc oxide (or similar sacrificial metal oxide) corrosion products which are more voluminous than the zinc anode material 20 which created them, as described previously. The steps of FIGS. 6, 7 and 8 are the same or similar to those discussed above with respect to FIGS. 2, 3 and 4. Examples of finished panels are shown trimmed to desired sizes from the panels 26 of FIGS. 4 and 8 in FIG. 9B and from a curved or arcuate panel 26 formed on an arcuate mold as seen in FIG. 9A.

Figure 4:
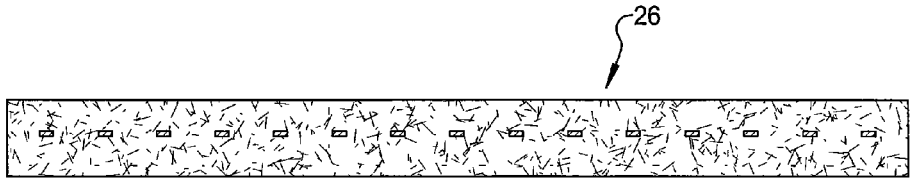
Figure 10:
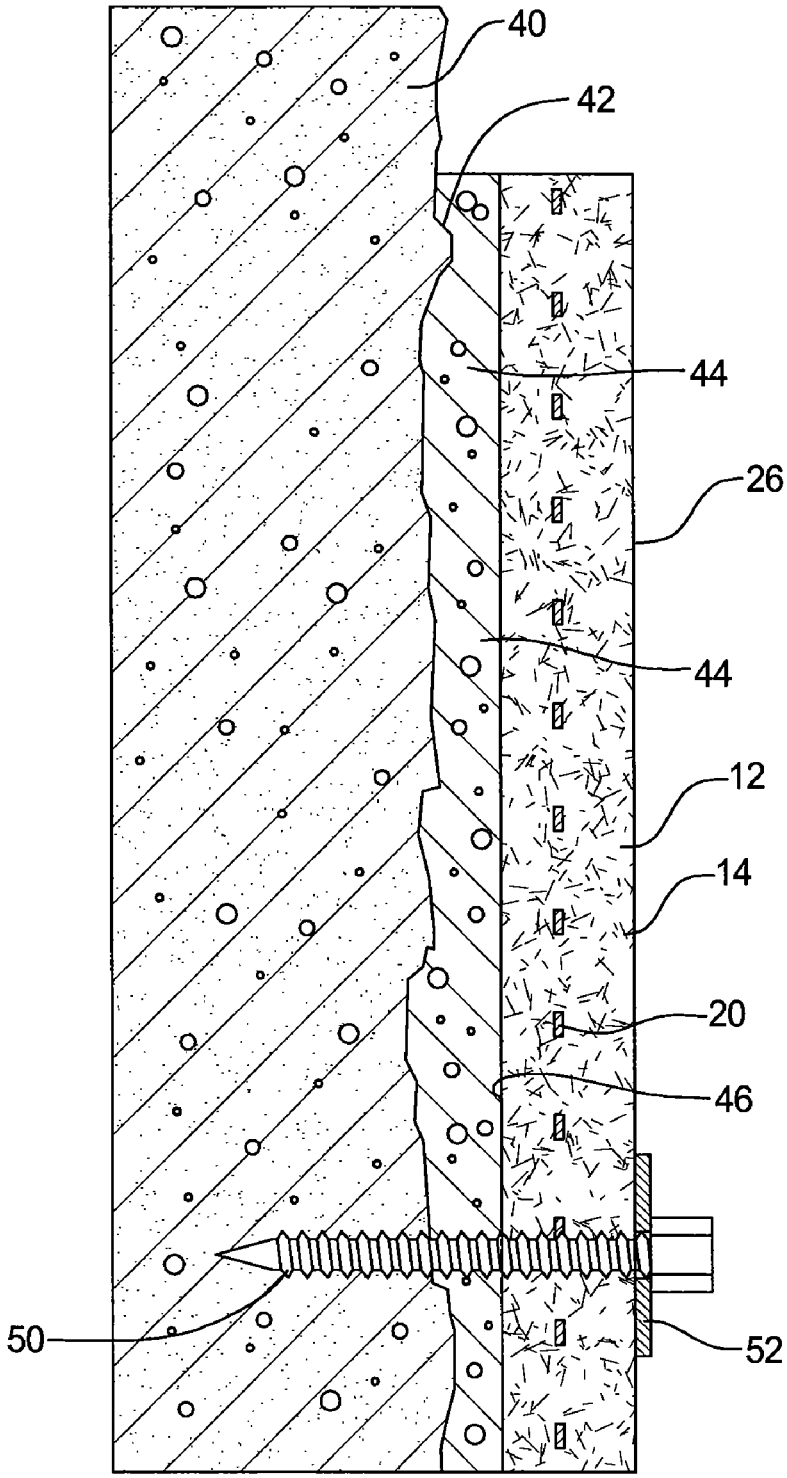
FIG. 10 is a side elevation view in section of a panel of the type shown in FIG. 4 attached to a concrete substrate with a conductive mortar or cement adhesive and an optional mechanical fastener.

An example of one field application of a panel 26 is shown in FIG. 10. A concrete structure 40 having a spalled or damaged outer surface 42 is shown being repaired by a galvanic panel 26, such as shown in FIG. 4 or FIG. 8. In this example a layer of galvanic adhesive mortar 44 is troweled by hand or pumped onto outer surface 42 and/or onto the inner surface 46 of panel 26.

Panel 26 is then pressed toward the concrete structure 40 to compress and partially extrude the conductive mortar or cement 44 between surfaces 42 and 46 to firmly bond the panel 26 to the concrete structure 40. Optionally, a conventional mechanical fastener such as a screw 50 and washer 52 can be inserted through the panel 26 and into the concrete 40 to add additional strength to the concrete-adhesive-panel assembly. The fastener 50, 52 can be temporary and removed after the adhesive mortar 42 sets, or permanently affixed to the panel, adhesive and concrete.

Figure 11:
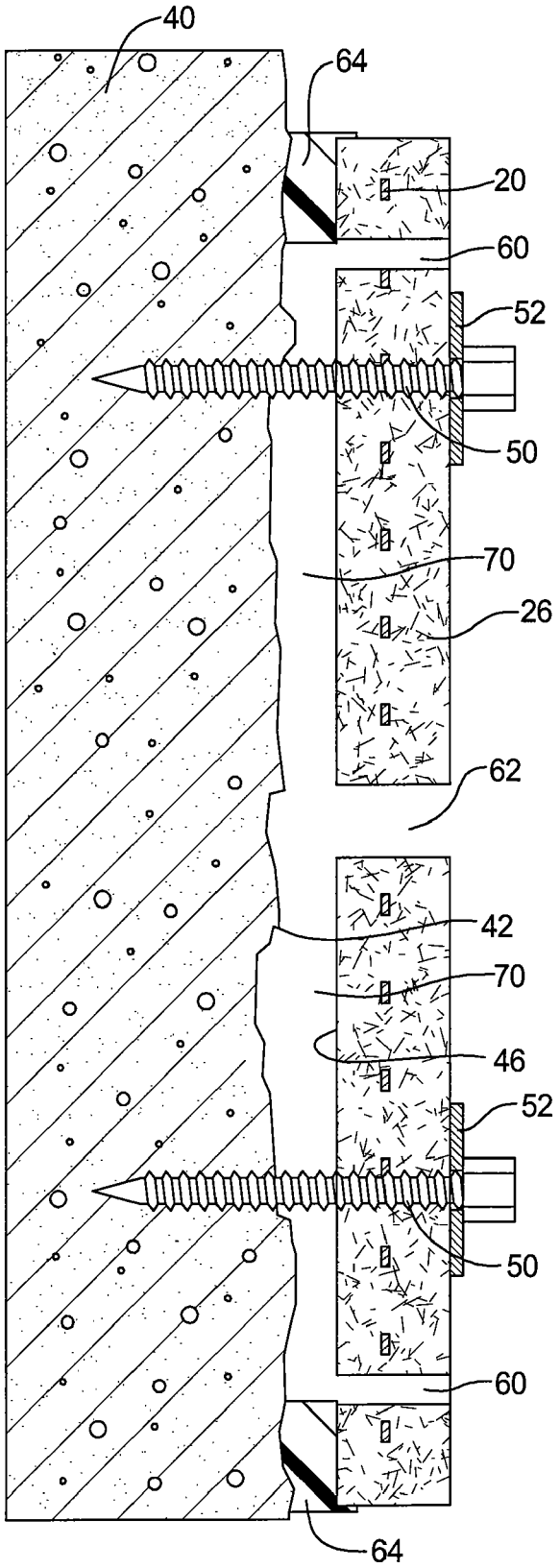
FIG. 11 is a view similar to FIG. 10 showing the use of a resilient gasket compressed between a concrete substrate and a composite anode panel.

Another embodiment is shown in FIG. 11 wherein panel 26 (such as shown in FIG. 4 or 8) is formed with one or more vent openings 60 and one or more injection fill ports 62. In this example, a circumferential compressible gasket or seal 64, such as a formed rubber strip or a bead of caulk, is applied around the perimeter of the spalled or damaged surface 42 of the concrete structure 40. Alternatively, gasket or seal 64 can be preformed or prefabricated on panel 26 prior to use in the field.

Once the panel 26 and seal or gasket 64 are positioned over the damaged or spalled concrete surface 42, fasteners 50, 52 can be used to hold the panel in a spaced-apart relation over surface 42 and to compress the seal or gasket 64 between surfaces 42 and 46. In this fashion, a void, cavity or chamber 70 is formed between the concrete 40 and the panel 26.

At this point, galvanic adhesive or concrete adhesive (such as the mortar or cement 44 discussed above) is injected under pressure through the injection port or ports 60 to completely fill the cavity or chamber 70. Air from cavity or chamber 70 is exhausted through vents 60 as the cavity or chamber 70 is filled with adhesive material 44. Once the adhesive material sets, the fasteners 50 may be removed or left in place.

Figure 12:
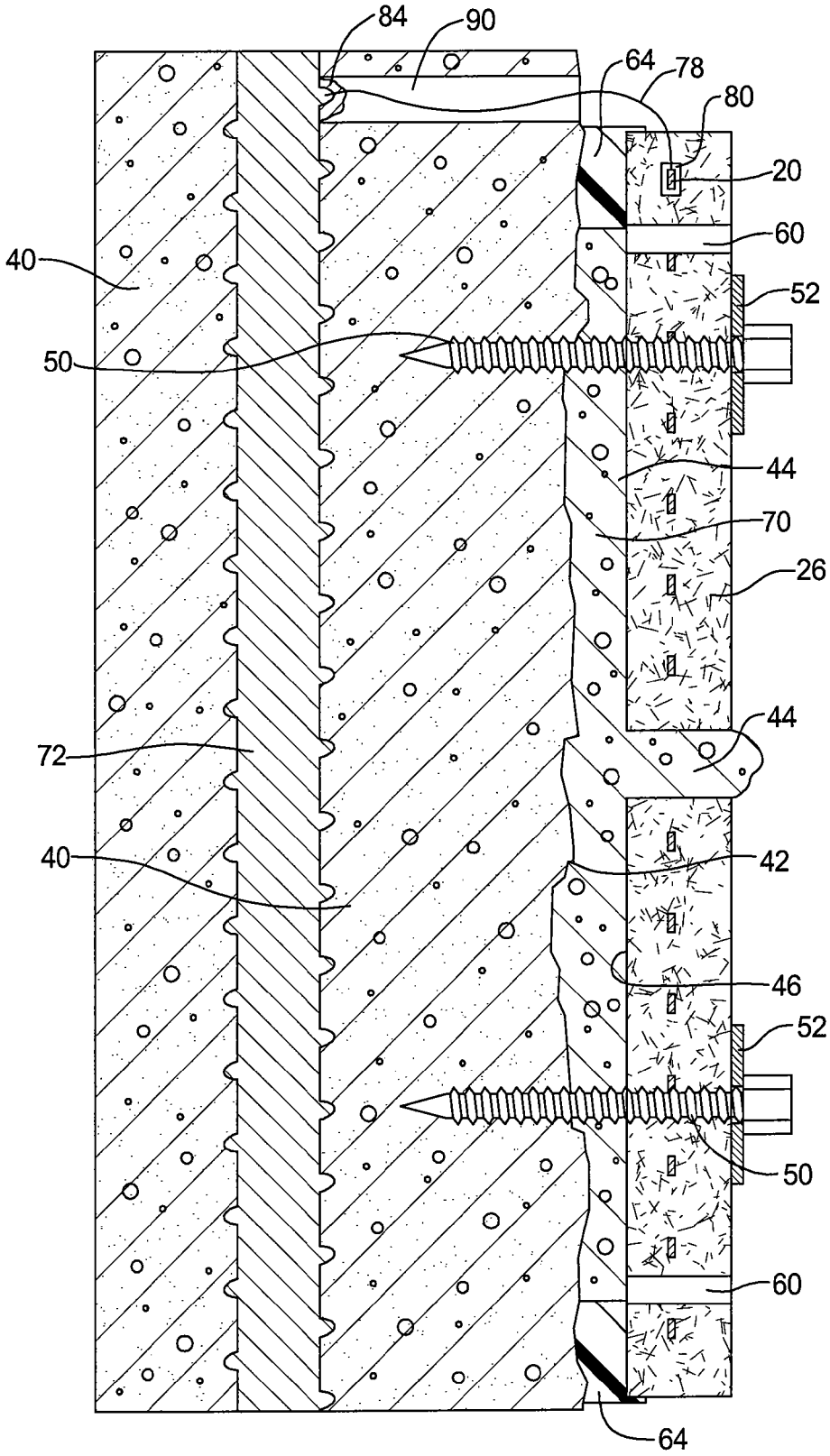
FIG. 12 is a view similar to FIG. 11 showing a panel functioning as a form for containing galvanic mortar, cement or concrete adhesive against a concrete substrate and electrically connected to a steel reinforcement bar within the concrete substrate.

Another embodiment of the disclosure is shown in FIG. 12. In this example, the concrete structure 40 is reinforced with one or more steel reinforcements such as rebar 72. One end of an electrically conductive member, such as a steel wire 78, is securely fixed to the zinc anode material 20 either during initial fabrication of the panel 26 prior to embedment of the anode material 20 in the conductive mortar 12, or in the field by removing a portion of the dry conductive mortar 12. In either case, the wire 78 can be soldered or welded or otherwise attached or connected to the zinc anode material 20 to form a secure joint 80.

Whether during initial construction of the concrete structure 40 (prior to setting) or as an in-field repair, the other end of wire 78 is soldered or welded to rebar 72 to form a second electrical connection or joint 84.

A bore hole, tunnel or other access channel 90 is formed in concrete structure 40 to provide access to secure wire 78 to rebar 72. Cavity 70 is then filled with electrically conductive adhesive 44 as discussed above. The adhesive 44 can be a commercially available galvanic adhesive such as the TAS-EZA mortar noted above which can be troweled or pumped onto a concrete structure. The adhesive 44 can also be produced by a modification of the TAS-EZA electrolytic mortar noted above.

In particular, Components A plus B of the TAS-EZA mortar can be strengthened with the addition of needle-like fibers such as Wollastonite and troweled onto one or both surfaces 42, 46 or pumped into the formed cavity of chamber 70. The substitution of Wollastonite for sand (Component C) provides a better cohesive strength to the adhesive mortar and improved freeze/thaw resistance to thermal cycling.

Another adhesive mortar formulation uses Component A and B of the TAS-EZA mortar and substitutes very short glass fibers such as one to two millimeters in length in place of Component C (sand). This adhesive mixture provides even better cohesive strength and freeze/thaw resistance than does the Wollastonite modified adhesive discussed immediately above. In each or these mortar modifications, the setting time to achieve "green" strength is improved (reduced) as well.

Both the conductive mortar 12 and the adhesive mortar 44 can also be prepared from cement mixes which incorporate one part cement to three parts by weight filler, although these ratios can vary over wide limits depending on the filler used and the physical properties required.

Cement used can be ordinary Portland cement; sulphate resistant Portland cement; a blend such as 70/30 by weight of Sulphate resistant or ordinary Portland cement and pulverized fly ash; and a blend such as 35/65 by weight of sulphate resistant or ordinary Portland cement and ground blast furnace slag.

Free water to cement ratio is adjusted from a base of 0.4 to a point where a suitable viscosity for spraying is achieved.

Fillers used in the anode panel mortar 12 need to be of a suitably fine particle size in order to facilitate spraying. A typical filler could be any of (but not limited to) the following: calcium carbonate, silica sand, calcium silicate, aluminosilicates, and pozzolanic metakaolins.

The filler material can also be relatively porous so that it can accommodate expansion of the zinc oxide during consumption of the anode. However voids which might fill with water should be avoided.

The galvanic anode panel mortar forms an electrolyte which is in electrolyic communication with the concrete structure 40 so that a current can flow from the zinc anode material 20 through the body of the galvanic panel 26 and hence through the adhesive mortar 44 and then to the underlying steel reinforcement. Ordinary Portland cement of about 0.6% alkali content expressed as $Na_2O$ equivalent can be used for example.

An ionically conductive material can also be incorporated into to the panel 26 after it has set and dried. The ionically conductive material is dissolved in a solvent such that it is in solution while migrating through the cement/mortar and such that the solution coats the surface of the voids existing within the cement/mortar panel and wicks through the voids leaving the ionically conductive material in the voids when the material comes out of solution. However the ionically conductive material can be supplied in any form such as gel or semi-liquid material which can migrate to ensure complete paths through the body of the cement/mortar, rather than merely pockets of ionically conductive material which are not connected and thus cannot conduct the ions through the body to the medium at the surface. The use of lithium hydroxide as admixture is of especial benefit when the mortar, concrete, or the like, has a low Na and K content (or a low Na or K content). $Li^+$ can assist in preventing alkali aggregate reaction.

In many cases a pore solution having pH values high enough for use in the above applications may be made either from Portland cements of intrinsically high alkali content (i.e. those containing relatively high proportions of $Na_2O$ and $K_2O$ or from cements of lower alkali content with supplementary alkalis (in the form of LiOH, NaOH or KOH for instance) incorporated into the mix materials as admixtures.

Where a potentially reactive aggregate is present, the mortar 12 can be made from a cement of relatively low alkali content with lithium hydroxide as an admixture. Typically, this would involve the addition of LiOH to the mix water at a concentration of about 1 mole/liter or higher, which would ensure the maintenance of a high pH value, necessary to sustain the activity of the zinc-based anode, while introducing a cation, $Li^+$ that is known to act as an inhibitor of alkali-silica reaction.

A commercially available flowable grout or mortar can also be utilized in the process to form panel 26. To be effective the grout or mortar should have a low volumetric resistivity to facilitate the cathodic protection system and several such grouts and mortars are commercially available and are well known to those skilled in the art.

The addition of Lithium salts has also been found to mitigate the harmful effects of anode corrosion products and promote anode activity and active life. Enhancement materials, such as lithium hydroxide or calcium chloride, have the advantage that they render the corrosion products more soluble so that the corrosion products themselves may diffuse in solution out of the anode body into the surrounding concrete. While it is still necessary to ensure pores are formed in the concrete/mortar once it sets and dries so that absorption of corrosion products can occur, the total volume of pores required may be reduced relative to the total volume of corrosion products in view of this diffusion of the corrosion products during the life of the process.

It will be appreciated by those skilled in the art that the above spray formed galvanic anode panel are merely representative of the many possible embodiments of the invention and that the scope of the invention should not be limited thereto, but instead should only be limited according to the following claims. For example, anode materials 20 other than zinc can be used effectively, such as cadmium, aluminum, magnesium, and any other materials which are galvanically sacrificial to steel.

What is claimed:

1. A galvanic anode panel, comprising:

an electrolytically conductive mortar material comprising tecto-alumino silicate;

elongated fibers coated by said electrolytically conductive mortar material; and a sacrificial anode covered by said electrolytically conductive mortar material and by said elongated fibers.

2. The panel of claim 1, wherein said sacrificial anode comprises zinc.

3. The panel of claim 1, wherein said elongated fibers comprise glass fibers.

4. The panel of claim 1, wherein said elongated fibers comprise Wollastonite.

5. The panel of claim 1, wherein said elongated fibers have a length in the range of 1 to 2 inches.

6. The panel of claim 1, further comprising a filler material dispersed throughout said electrolytically conductive mortar.

7. The panel of claim 6, wherein said filler material comprises an expanded material.

8. The panel of claim 1, further comprising a resilient seal applied around said anode panel.

9. A galvanic anode panel, comprising:

a first layer of elongated glass fibers embedded in a first layer of electrolytically conductive mortar material comprising tecto-alumino silicate;

a second layer of elongated glass fibers embedded in a second layer of electrolytically conductive mortar material comprising tecto-alumino silicate; and a sacrificial zinc anode layered between said first and second layers of elongated glass fibers and electrolytically conductive mortar material.

10. The panel of claim 9, wherein said sacrificial zinc anode is formed with an open construction allowing contact and electrolytic conduction between said first and second layers of elongated glass fibers and electrolytically conductive mortar.

11. A method of making a galvanic anode panel, comprising:

spraying a mixture of mortar and reinforcing fibers onto a mold to form a base layer;

placing a sacrificial anode on said base layer; and spraying said mixture over said sacrificial anode so as to form a top layer and to embed said sacrificial anode within said mixture.

12. The method of claim 11, further comprising consolidating said base layer and spraying said mixture over said base layer to form an intermediate layer prior to spraying said top layer.

13. The method of claim 11, wherein said sacrificial anode comprises perforations and wherein said top layer is sprayed through said perforations.

14. The method of claim 11, wherein said mortar and said reinforcing fibers are sprayed onto said mold in two spray streams.

* * * * *